US005174130A

United States Patent [19]

Lucas

[11] Patent Number: 5,174,130

[45] Date of Patent: Dec. 29, 1992

[54] REFRIGERATION SYSTEM HAVING STANDING WAVE COMPRESSOR

[75] Inventor: Timothy S. Lucas, Glen Allen, Va.

[73] Assignee: Sonic Compressor Systems, Inc., Glen Allen, Va.

[21] Appl. No.: 493,380

[22] Filed: Mar. 14, 1990

[51] Int. Cl.[5] ..... F25B 1/00; F25B 9/00; F04B 35/00

[52] U.S. Cl. ..... 62/498; 62/6; 62/DIG. 2; 417/52; 417/207; 417/240; 417/322; 417/902

[58] Field of Search ..... 62/6, 467, 515, 118, 62/DIG. 2, 498, 468; 417/52, 53, 207, 208, 209, 240, 322, 902

[56] References Cited

U.S. PATENT DOCUMENTS

| | | | |
|---|---|---|---|
| 2,836,033 | 5/1958 | Marrison | 60/516 |
| 2,842,067 | 7/1958 | Stevens | 417/322 X |
| 3,006,154 | 10/1961 | Brandon | 62/118 X |
| 3,255,601 | 6/1966 | Brandon | 417/52 X |
| 3,606,583 | 9/1971 | Coughenour et al. | 417/240 X |
| 3,743,446 | 7/1973 | Mandroian | 417/322 X |
| 3,937,600 | 2/1976 | White . | |
| 4,114,380 | 9/1978 | Ceperley | 62/467 R X |
| 4,349,757 | 9/1982 | Bhate . | |
| 4,355,517 | 10/1982 | Ceperley | 60/721 |
| 4,398,398 | 8/1983 | Wheatley et al. . | |
| 4,483,158 | 11/1984 | Arkharov et al. | 62/467 X |
| 4,489,553 | 12/1984 | Wheatley et al. . | |
| 4,534,176 | 8/1985 | Horn et al. | 62/6 |
| 4,566,291 | 1/1986 | Halavais | 62/467 X |
| 4,602,174 | 7/1986 | Redlich . | |
| 4,640,667 | 2/1987 | Trepp | 417/52 |
| 4,664,685 | 5/1987 | Young | 62/6 |
| 4,722,201 | 2/1988 | Hofler et al. . | |
| 4,858,441 | 8/1989 | Wheatley et al. . | |
| 4,858,717 | 8/1989 | Trinh et al. | 62/467 |
| 4,924,675 | 5/1990 | Higham et al. | 62/6 |
| 4,953,366 | 9/1990 | Swift et al. | 62/467 |
| 4,969,807 | 11/1990 | Kazumoto et al. | 62/6 X |
| 5,020,977 | 6/1991 | Lucas . | |

FOREIGN PATENT DOCUMENTS 356514 12/1980 Austria .

OTHER PUBLICATIONS

Soviet Inventions Illustrated, P.Q. sections, week C25, Jul. 25, 1980, Derwent Publications Ltd., London, Q5.

Institute of Vibration Research at the Technical University of Berlin, "A Method for the Production of Extremely Powerful Standing Sound Waves in Air", by Hermann Oberst. (1940).

J. Acoust. Soc. AM. 74 (1), Jul. 1983, "An Intrinsically Irreversible Thermoacoustic Heat Engine", by Wheatley et al., pp. 153-170.

Am. J. Phys., vol. 53, No. 2, Feb. 1985, "Understanding Some Simple Phenomena in Thermoacoustics with Applications to Acoustical Heat Engines", by Wheatley et al., pp. 147-162.

"The Natural Heat Engine", by Wheatley et al., Reprinted from Los Alamos Science Fall 1986, No. 14, pp. 2-33.

J. Acoust. Soc. Am., Vol. 84, No. 4, Oct. 1988, "Thermoacoustic Engines", by G. W. Swift, pp. 1145-1180.

Los Alamos, Los Alamos National Laboratory, "Parametrically Driven Variable-Reluctance Generator", by W. B. Wright and G. W. Swift, pp. 1-17.

Metallurgical Division, U.S. Bureau of Mines, Dept. of the Interior, May 1941, vol. 12, "An Electromagnetic Sound Generator for Producing Intense High Frequency Sound", by Hillary W. St. Clair, pps. 250-256.

*Primary Examiner*—Henry A. Bennett
*Assistant Examiner*—Christopher B. Kilmer
*Attorney, Agent, or Firm*—Staas & Halsey

[57] ABSTRACT

A compression-evaporation refrigeration system, wherein gaseous compression of the refrigerant is provided by a standing wave compressor. The standing wave compressor is modified so as to provide a separate subcooling system for the refrigerant, so that efficiency losses due to flashing are reduced. Subcooling occurs when heat exchange is provided between the refrigerant and a heat pumping surface, which is exposed to the standing acoustic wave within the standing wave compressor. A variable capacity and variable discharge pressure for the standing wave compressor is provided. A control circuit simultaneously varies the capacity and discharge pressure in response to changing operating conditions, thereby maintaining the minimum discharge pressure needed for condensation to occur at any time. Thus, the power consumption of the standing wave compressor is reduced and system efficiency is improved.

25 Claims, 6 Drawing Sheets

REFRIGERATION SYSTEM HAVING STANDING WAVE COMPRESSOR

CROSS REFERENCE TO RELATED APPLICATIONS

This application is related to U.S. patent application Ser. No. 07/380,719 filed Jul. 12, 1989, which is a continuation in part of U.S. application Ser. No. 07/256,322 filed Oct. 11, 1988.

BACKGROUND OF THE INVENTION

1) Field Of Invention

This invention relates to compression-evaporation cooling equipment.

2) Description Of Related Art

Heretofore, compression-evaporation cooling systems have relied on mechanical compressors for their operation. Although compression-evaporation systems offer comparatively high efficiency, the use of mechanical compressors requires certain design compromises, which serve to reduce the refrigeration system's overall efficiency.

It is well known, that "flashing" of the liquid refrigerant as it enters the evaporator, reduces the refrigerating effect per pound of refrigerant. This sudden liquid-to-gas change of state, occurs when the liquid refrigerant cools from the condensing temperature to the evaporator temperature. Since this change of state comes at the expense of the liquid refrigerant's internal energy, no useful cooling occurs. Flashing can be reduced by subcooling the liquid refrigerant before it enters the evaporator. However, significant subcooling requires another cooling system with its own energy requirements. To determine the benefit of subcooling in a given system, the energy saved due to reduced flashing, must be compared with the energy consumed by the subcooling system.

Heat exchangers between the suction vapor and the liquid refrigerant have been employed in smaller systems to provide subcooling. However, the loss of efficiency associated with suction vapor superheating, can limit the efficiency gain of this kind of subcooling.

Mechanical compressors which are employed in compression-evaporation systems provide a fixed displacement, which is difficult to vary during operation. Thus, their discharge pressure is also difficult to vary. For compression-evaporation systems, the compressor's discharge pressure must be high enough to provide condensation at the highest temperature of the condensing medium. As such, the design choice of the compressor's discharge pressure must be made on a worst-case basis. During periods when the condensing medium's temperature is below this worst-case temperature, the discharge pressure of the compressor is larger than the minimum pressure required for condensation to occur. Therefore, during normal operating conditions, energy is wasted by producing excessive discharge pressures.

For example, a compressor's discharge pressure for a typical residential refrigerator might be designed to sustain condensation at room air temperatures of up to 100 degrees Fahrenheit. During periods when the room's air temperature is below 100 degrees Fahrenheit, a lower discharge pressure could sustain condensation. Thus, during periods of average room air temperatures, the compressor wastes energy by producing discharge pressures which are higher than necessary. Also, the selection of electric motors is made on this same worst case basis. The electric motor must be capable of startup and pulldown of a warm refrigerator, during periods of high room temperature. Consequently, a motor must be used whose power consumption is greater than the minimum required for normal operation.

In short, any compression-evaporation system where the condensing medium's temperature changes, will suffer from these inefficiencies. These fixed discharge pressure considerations can also be applied to heat-pumps and air-conditioners. During periods when the indoor-outdoor temperature difference is small, the minimum pressure differential needed is reduced. Since mechanical compressors cannot easily vary their displacement, compression-evaporation systems are unable to exploit the increased efficiency of a variable discharge pressure.

The design of mechanical compressors with variable displacement, has always led to the addition of many more moving parts. These extra moving parts decrease the compressor's efficiency and dependability. Consequently, the advantages offered by a variable discharge pressure, remain unexploited.

It is well known that a variable capacity compressor can provide gains in overall system efficiency. Variable capacity compressors have been achieved in the past, by combining variable speed electric motors with mechanical compressors. However, such systems have never offered both variable capacity and variable discharge pressure in a single compressor.

It is clear that there is a need for a compressor technology which can provide an efficient subcooling system, a variable discharge pressure, and variable capacity. If such a compressor technology were available, the efficiency of compression-evaporation cooling systems could be advanced considerably.

SUMMARY OF THE INVENTION

It is the object of the present invention to provide a compression-evaporation cooling system, whereby a standing wave compressor serves to compress a gaseous refrigerant and then subcool that refrigerant, while expending only minimal additional energy for subcooling.

It is another object of the present invention to provide a compression-evaporation cooling system, wherein both the capacity and the discharge pressure of the standing wave compressor can be simultaneously varied as a function of the cooling system's operating conditions, thereby increasing the system's efficiency by reducing the compressor's energy consumption.

It is a further object of the present invention to provide additional acoustical drivers for the standing wave compressor which can efficiently create high amplitude acoustic waves.

It is a still further object of the present invention to provide an improved acoustic chamber which suppresses unwanted higher acoustic modes, and promotes a larger pressure differential.

It is an even further object of the present invention to provide all of these advantages without the addition of any moving parts.

The present invention is directed to a refrigerant compressor including a standing wave compressor having a variable acoustic driver for driving a standing acoustic wave to compress refrigerant. A control circuit varies the power of the variable power acoustic driver based on changes in the operating conditions of the standing wave compressor, so that the discharge pressure of the standing wave compressor is varied as a function of the change in operating conditions.

In another aspect, the present invention is directed to a refrigerant compressor including a standing wave compressor for compressing a refrigerant by creating a standing acoustic wave. The standing wave creates a temperature differential along the standing wave compressor, so that a first portion of the standing wave compressor is at a temperature which is higher than a second portion of the standing wave compressor. A heat exchanger is coupled to the standing wave compressor adjacent the second portion of the standing wave compressor so that the heat exchanger provides thermal contact between the refrigerant and the second portion of the standing wave compressor. By using the heat exchanger, the refrigerant can be sub-cooled before being provided to the evaporator, thereby enhancing cooling efficiency. The cooling efficiency can be further enhanced by providing heat pumping surfaces within the standing wave compressor. The heat pumping surfaces are exposed to the standing acoustic wave, so that a temperature differential is created along the heat pumping surfaces.

These and other objects and advantages of the invention will become apparent from the accompanying specifications and drawings, wherein like reference numerals refer to like parts throughout.

DETAILED DESCRIPTION OF THE PREFERRED EMBODIMENTS

Figure 1:
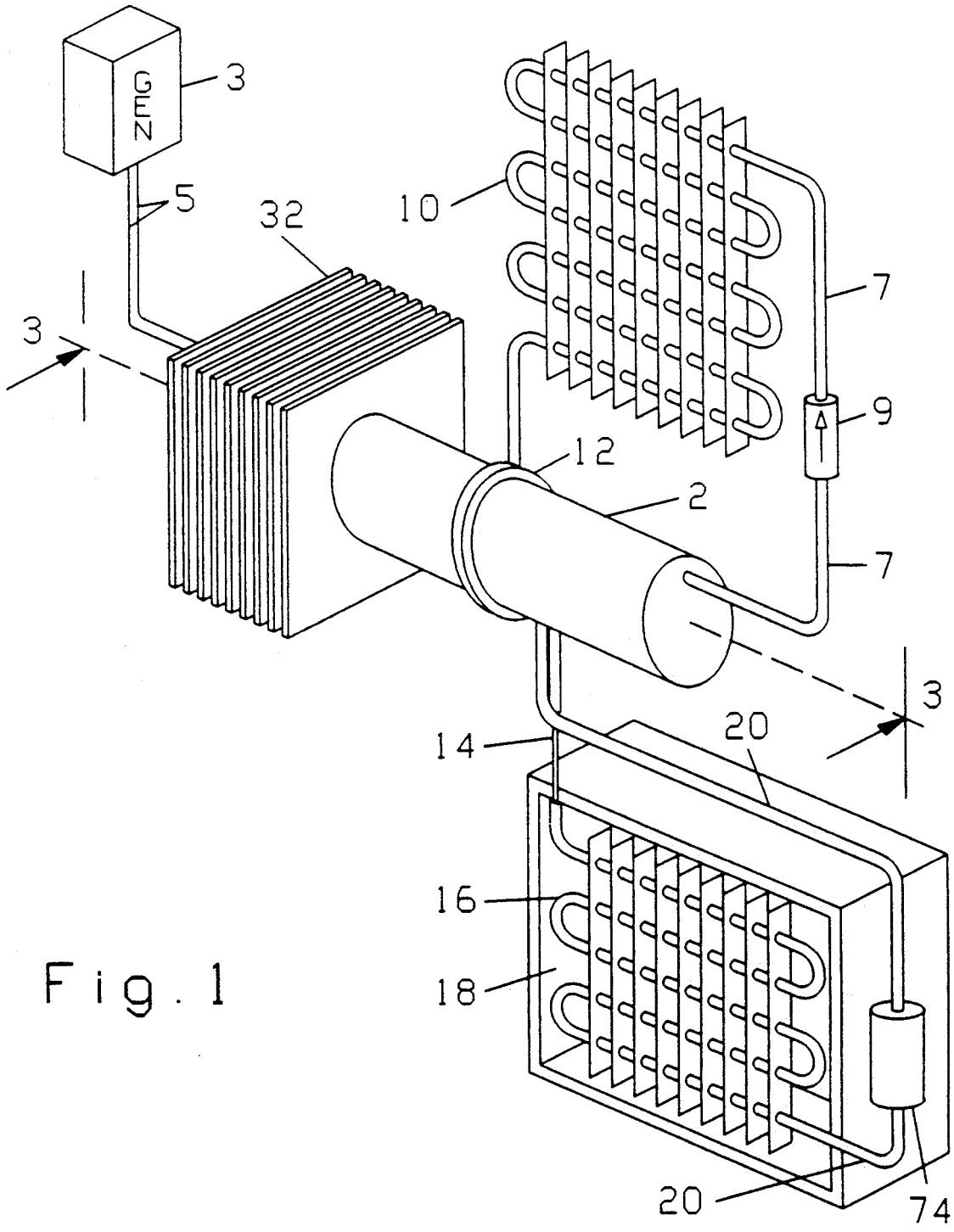
FIG. 1 is a perspective view of an embodiment of a refrigerant compressor in accordance with the present invention, which is driven by an acoustic driver.
Figure 2:
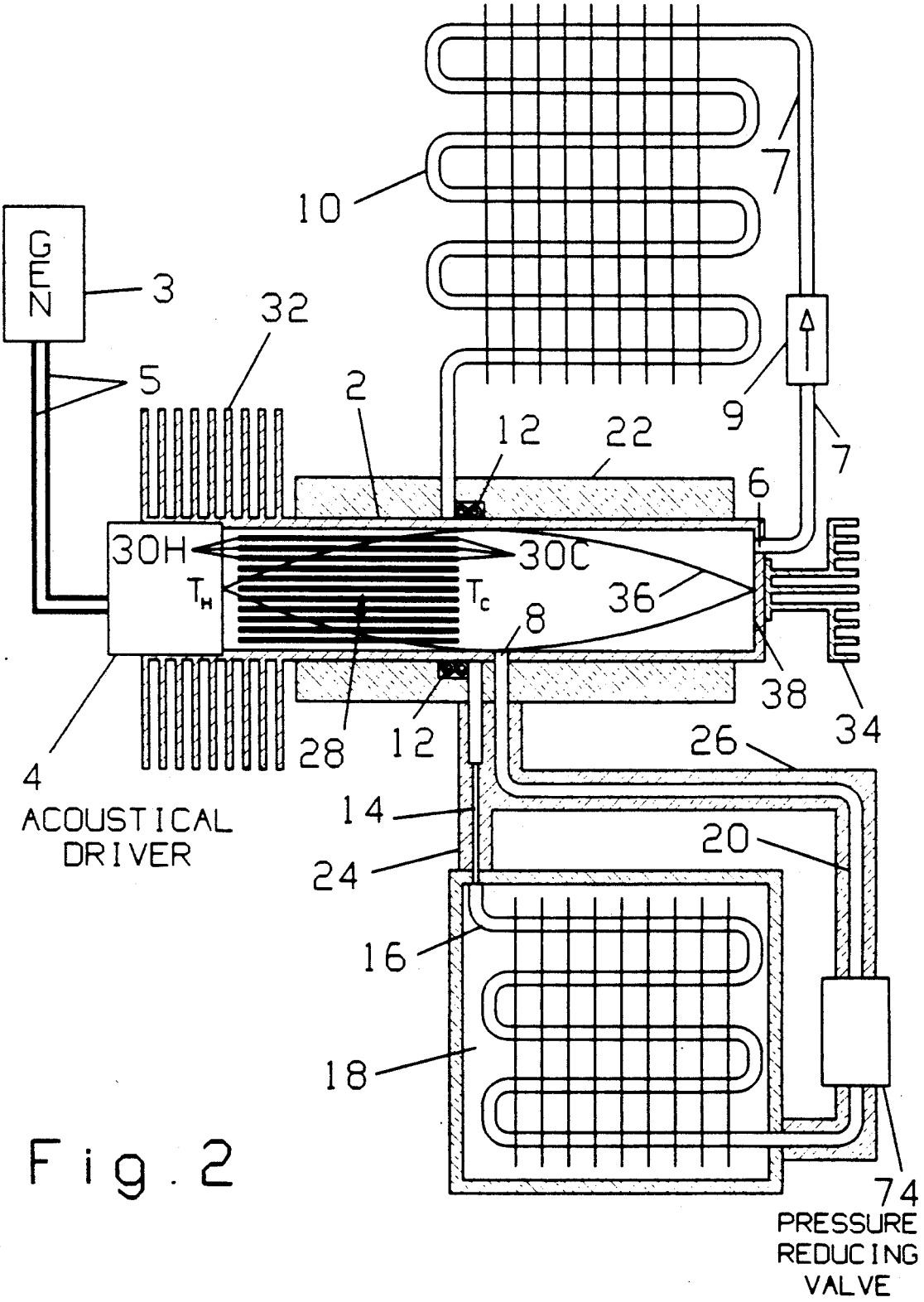
FIG. 2 is a section on line 3—3 of FIG. 1.

FIG. 1 is a perspective view of an embodiment of a refrigerant compressor in accordance with the present invention, which provides a liquid refrigerant subcooling system, and FIG. 2 is a sectional view along line 3—3 of FIG. 1. The compressor for this compression-evaporation system is a standing wave compressor, formed by a chamber 2, an acoustical driver 4, a generator 3, a discharge port 6, and a suction port 8. The theory and operation of the standing wave compressor, is disclosed in related U.S. patent application Ser. No. 07/380,719 filed Jul. 12, 1989, the contents of which is hereby incorporated by reference, and is not reproduced herein.

Referring to FIGS. 1 and 2, discharge tubing 7 connects a discharge port 6 to a check valve 9, and connects check valve 9 to the input side of a condenser 10. Check valve 9 prevents any back flow from condenser 10 into chamber 2, during off periods of the standing wave compressor. The output of air-cooled condenser 10 is connected to a heat exchanger coil 12. Heat exchanger coil 12 forms a coil of tubing which is wound around and welded to chamber 2, so as to provide good thermal contact between chamber 2 and heat exchanger coil 12. The output of heat exchanger coil 12 is connected to a capillary tube 14. Capillary tube 14 is connected to the input of an evaporator 16 which is located inside a refrigerated space 18. Suction tubing 20 connects the output of evaporator 16 to a pressure reducing valve 74, and connects pressure reducing valve 74 to suction port 8 of chamber 2.

The midsection of chamber 2 is thermally isolated from the environment by insulation 22 (not shown in FIG. 1). Capillary tube 14 and heat exchanger coil 12 are thermally isolated from the environment by insulation 24. Suction tubing 20 is thermally isolated from the environment by insulation 26.

A heat pump plate stack 28 is provided inside of chamber 2. Heat pump plate stack 28 includes a stack of evenly spaced parallel stainless steel plates which are placed longitudinally along the length of chamber 2. Alternatively, the plates can be made of other materials such as fiberglass or wire screens. A more detailed view of heat pump plate stack 28 is provided in FIG. 3.

Figure 3:
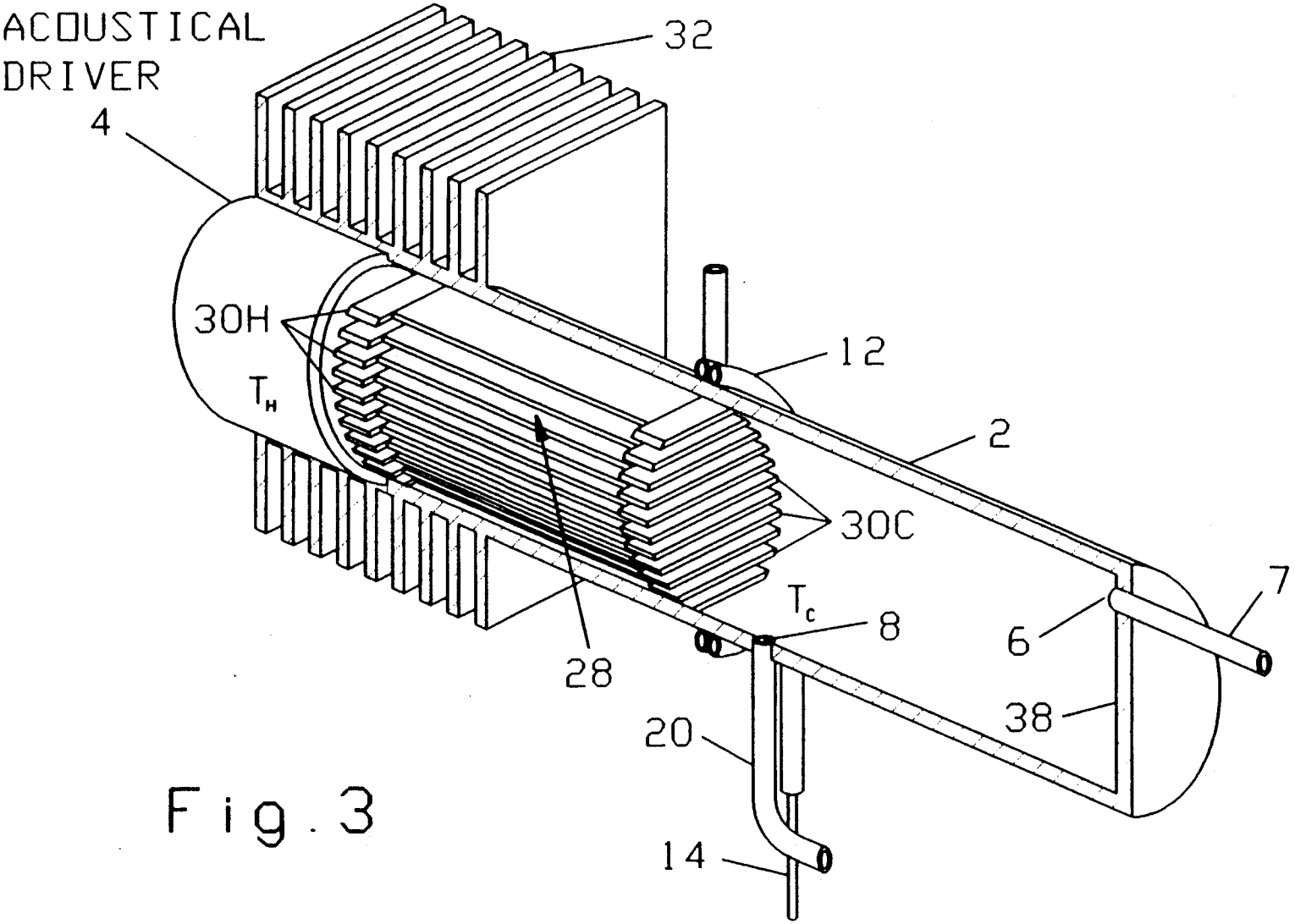
FIG. 3 is a sectional view of the refrigerant compressor of FIG. 1, which provides a detailed view of the heat pump plate stack.

Heatpump plate stack 28 is everywhere thermally isolated from chamber 2, except at opposite ends $T_C$ and $T_H$. At opposite ends $T_C$ and $T_H$ of each individual plate in heat pump plate stack 28, are located respective copper strips 30C and 30H. As seen in FIG. 3, copper strips 30C and 30H extend along the ends of each individual plate of heat pump plate stack 28 and are soldered thereto. None of the plates in heatpump plate stack 28 come in contact with the inner surface of chamber 2. Thermal contact between heatpump plate stack 28 and chamber 2 is provided by copper strips 30H and 30C. The two ends of each copper strip extend beyond the plates to meet the inner surface of chamber 2, and are soldered thereto. Copper strips 30C provide good thermal contact between end $T_C$ of heat pump plate stack 28 and the wall of chamber 2. Copper strips 30H provide good thermal contact between end $T_H$ of heat pump plate stack 28 and the wall of chamber 2. This arrangement allows heat conduction, between heat pump plate stack 28 and chamber 2, to occur only at ends $T_C$ and $T_H$. Chamber 2 is also provided with heat fins 32 and 34, for the dissipation of heat from the walls of chamber 2 to the surrounding air.

In operation, generator 3 supplies electromagnetic energy to acoustic driver 4, by way of wires 5. Acoustic driver 4 emits acoustic waves into the gaseous refrigerant inside chamber 2. The frequency of acoustic driver 4 is controlled in such a way as to maintain a standing acoustical wave as illustrated by waveform 36 which depicts the displacement amplitude of the standing acoustic wave. Waveform 36 represents the first resonant mode of chamber 2.

As disclosed in related patent application Ser. No. 07/380,719 filed Jul. 12, 1989, the gaseous refrigerant inside chamber 2 is acoustically compressed and discharged through discharge port 6. This high pressure gaseous refrigerant then passes through check valve 9 and into air-cooled condenser 10, by way of discharge tubing 7. Check valve 9 prevents the refrigerant in condenser 10 from flowing back into chamber 2 when acoustic driver 4 is cycled off. The gaseous refrigerant then condenses to a liquid within condenser 10 by giving up heat to the surrounding air. Liquid refrigerant then flows from air-cooled condenser 10 into heat exchanger coil 12, wherein it is subcooled to below its previous condenser temperature. The basis for this cooling is treated separately below. Subcooled liquid refrigerant then flows out of heat exchanger coil 12 and into capillary tube 14, which serves to meter the flow of liquid refrigerant into evaporator 16. Insulation 24 minimizes the heating of the liquid refrigerant in capillary tube 14, as the refrigerant passes between the heat exchanger coil 12 and the evaporator 16.

Once in evaporator 16, the liquid refrigerant absorbs its heat of vaporization from refrigerated space 18. This low temperature low pressure vapor is then drawn out of evaporator 16 and into chamber 2, by passing in turn through suction tubing 20, pressure reducing valve 74, and into suction port 8. Inside chamber 2, the gaseous refrigerant is acoustically compressed and the cycle is repeated. Pressure reducing valve 74 is optional, and is provided for applications where it is desireable to vary the amplitude of the standing acoustic wave. When the amplitude of the standing acoustic wave is increased, the suction pressure will decrease. Pressure reducing valve 74 prevents the pressure of evaporator 16 from dropping below the designed evaporator pressure.

The liquid refrigerant subcooling which occurs in heat exchanger coil 12 is explained as follows. It has been shown experimentally that the presence of a standing acoustical wave in a chamber, will cause heat to be pumped along the walls of the chamber. The direction of this heat pumping is away from the pressure nodes and towards the pressure antinodes. Consequently, the chamber walls grow colder at the pressure nodes and warmer at the pressure antinodes. The quantity of heat pumped is proportional to the surface area exposed to the standing acoustic wave. Therefore, the heat pumping effect can be increased by providing heat pump plate stack 28 inside chamber 2.

In the presence of the standing acoustic wave, represented by waveform 36, heat will be pumped away from the cold side $T_C$ and towards the hot side $T_H$ of heat pump plate stack 28. Copper strips 30C, are in thermal contact with both cold side $T_C$ of heat pump plate stack 28, and the walls of chamber 2. When the temperature of side $T_C$ drops below the temperature of the adjacent wall of chamber 2, heat flows in turn from heat exchanger coil 12, through the wall of chamber 2, through the copper strips 30, and into cold side $T_C$ of heat pump plate stack 28.

As heat accumulates at the hot end $T_H$ of heat pump plate stack 28, the temperature of hot end $T_H$ rises above the wall temperature of chamber 2. Coppers strips 30H, are in thermal contact with both hot side $T_H$ of heat pump plate stack 28, and the walls of chamber 2. When the temperature of side $T_H$ rises above the temperature of the adjacent wall of chamber 2, heat flows in turn from hot side $T_H$ of heat pump plate stack 28, through copper strips 30H, through the wall of chamber 2, through heat fins 32, and into the surrounding air of the environment. Thus, as the liquid refrigerant flows through heat exchanger coil 12, it is subcooled to a temperature below that of the air which surrounds air-cooled condenser 10.

A detailed theoretical and experimental description of the acoustical heat pumping effect which has been described above, is provided in the following publications. (1) John Wheatley, T. Hofler, G. W. Swift, and A. Migliori, An Intrinsically Irreversible Thermoacoustic Heat Engine, J. Acoust. Soc. Am., Vol. 74, No. 1, p. 153 July 1983 (2) John Wheatley, T. Hofler, G. W. Swift, and A. Migliori, Understanding Some Simple Phenomena In Thermoacoustics With Applications To Acoustical Heat Engines, Am. J. Phys., Vol. 53, No. 2, p. 147 February 1985 (3) John Wheatley, G. W. Swift, and A. Migliori, The Natural Heat Engine, LosAlamos Science, No. 14, Fall 1986 (4) G. W. Swift, Thermoacoustic Engines, J. Acoust. Soc. Am., Vol. 84, No. 4, p. 1145 October 1988. These papers teach how to design and predict the performance of an acoustic heat pumping system in quantitative detail, and the disclosures of these publications are hereby incorporated by reference.

To maximize the cooling capacity of the acoustic heat pumping system, all non-refrigerant heat loads on heat pump plate stack 28 should be kept to a minimum. The following considerations help to achieve this minimization.

Some heat pumping will occur along the walls of chamber 2 towards end wall 38 of chamber 2, thus causing heat to accumulate at end wall 38. Also, end wall 38 will experience some heating due to the acoustic pressure exerted on it by the standing acoustic wave. Due to acoustic streaming of the gas, the heat of end wall 38 could be conducted through the gas to the cold side $T_C$ of heat pump plate stack 28. This additional heat load would reduce the cooling capacity of the acoustic heat pumping system. To minimize this additional heat load, end wall 38 is provided with heat fins 34 which allow the heat accumulated on end wall 38 to be transferred to the surrounding air of the environment.

Insulation 22 reduces the heat absorbed by the walls of chamber 2 from the surrounding air, thereby promoting the refrigerant within heat exchanger coil 12 as the primary heat source of heat pump plate stack 28.

Another consideration for minimizing heat loads to the acoustic heat pumping system, is to locate acoustical driver 4 at the hot side $T_H$ of heat pump plate stack 28. In this way, the heat generated by acoustical driver 4 will tend to escape to the environment through heat fins 32. However, acoustical driver 4 could also be located at far wall 38 of chamber 2, and still provide some degree of subcooling for the liquid refrigerant, as well as maintaining the acoustical compression and discharge of the gaseous refrigerant. Therefore, the exact placement of acoustical driver 4 is not critical.

Insulation 26 minimizes the superheating of the refrigerant vapor in suction tubing 20, as the vapor passes between the evaporator 16 and suction port 8. Minimizing suction vapor superheating also helps to reduce the heat load on the acoustic heat pumping system.

This acoustic subcooling system, as described above, will serve to reduce the temperature of the liquid refrigerant before it enters evaporator 16, thereby minimizing flashing. Thus, the refrigerating effect per pound of refrigerant circulated is increased, and the overall system efficiency is improved.

Figure 4:
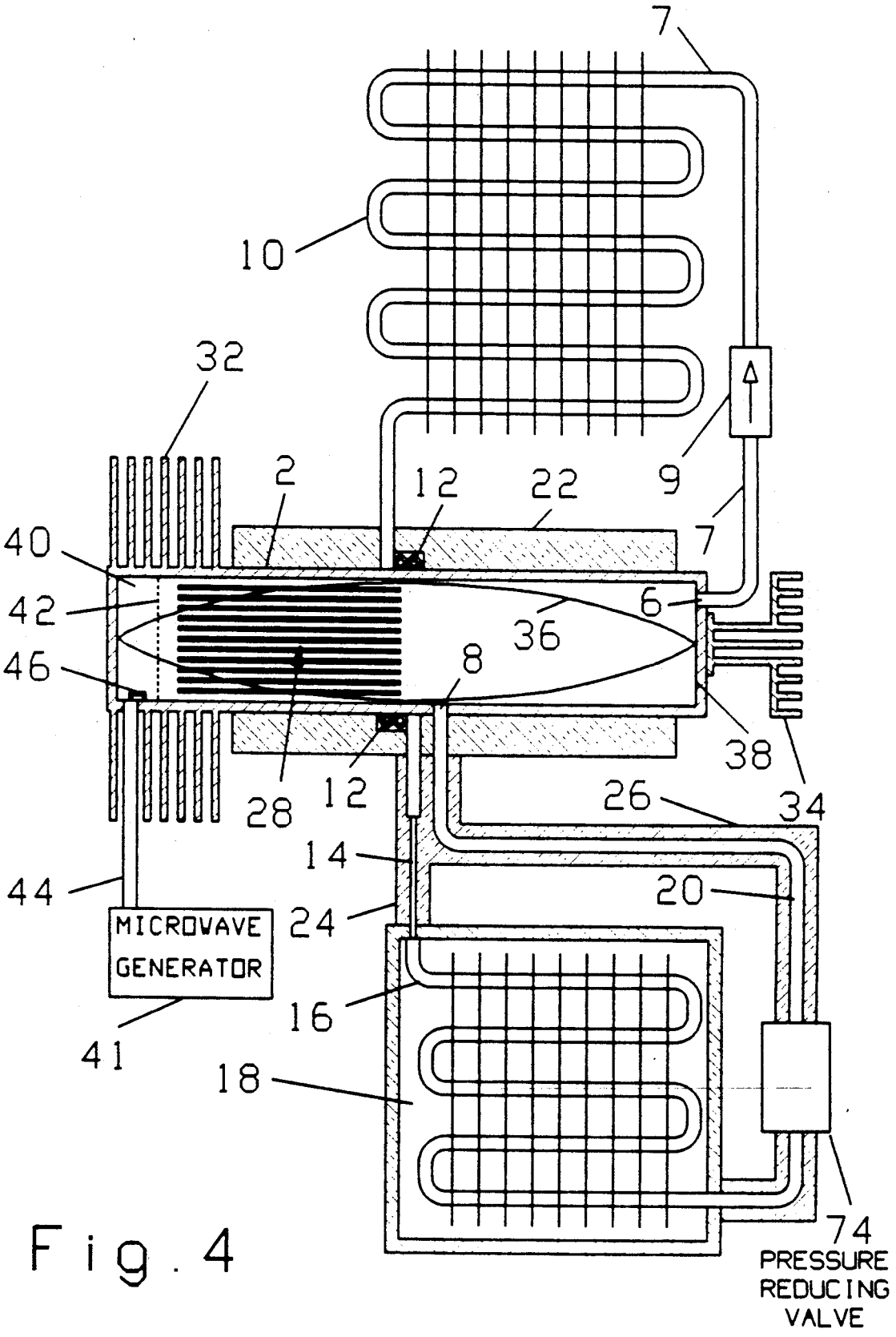
FIG. 4 is a section on line 3—3 of FIG. 1, with the acoustical driver having been replaced by a microwave driving system.

FIG. 4 shows a refrigeration system similar to that described for FIG. 2, except that the acoustical standing wave is driven by electromagnetic-gas interactions. Acoustical driver 4 of FIG. 2 is replaced in FIG. 4 by a microwave resonant cavity 40. The boundaries of microwave resonant cavity 40 are defined by the walls of chamber 2 and a transverse wire mesh 42. Coaxial cable 44 passes through the wall of chamber 2 and into microwave cavity 40. Coaxial cable 44 delivers microwave energy to microwave radiator 46. Microwave radiator 46 radiates microwave energy into microwave cavity 40, causing a resonant microwave mode to be established in microwave cavity 40. Wire mesh 42 prevents the microwave energy from leaving microwave cavity 40, but is transparent to the longitudinal acoustic oscillations within chamber 2. Typically, a pulsed or modulated microwave generator 41 provides microwave energy to microwave resonant cavity 40. The presence of this microwave energy in microwave resonant cavity 40, causes a standing acoustical wave to be established in chamber 2. Other wavelengths of electromagnetic energy besides microwaves can be used, as long as the energy is readily absorbed by the gaseous refrigerant. A disclosure of acoustical driving by means of electromagnetic-gas interactions is provided in related U.S. patent application Ser. No. 07/380,719 filed Jul. 12, 1989.

Once the standing acoustical wave is established in chamber 2 the refrigeration system of FIG. 4 operates in the same manner and according to same theory and principles as the refrigeration system of FIG. 2. Heat fins 32 help to conduct any excess gas heat out of chamber 2, which may result from incomplete microwave-to-acoustic transduction.

Variable Discharge Pressure and Variable Capacity

One of the advantages of employing the standing wave compressor in a compression-evaporation system, is the ability to vary both the discharge pressure and capacity. These advantages will exist with or without the subcooling system previously described.

The discharge pressure of a mechanical compressor, must be able to accommodate the highest condensing medium temperatures that the gaseous refrigerant is likely to encounter. During periods when the condensing medium's temperature is below this peak value, a lower discharge pressure could be used and still provide condensation at the lower condensing medium's temperature. If a compressor continues to produce a high discharge pressure when the condensing medium's temperature is low, then energy is wasted by the compressor.

A variable discharge pressure can be achieved with the standing wave compressor by simply varying the acoustic amplitude of the standing acoustic wave. Thus, a simple control circuit can be provided to vary the acoustic amplitude as a function of the condensing medium's temperature, or other system variables. In this way, the discharge pressure of the standing wave compressor would never be any larger than the minimum discharge pressure needed for condensation to occur at the existing operating conditions. Therefore, no energy is wasted by generating discharge pressures which are in excess of the minimum pressure required for condensation to occur.

When the acoustic amplitude is increased to provide a higher discharge pressure at the pressure antinodes, the suction pressure at the pressure nodes will tend to decrease. Therefore, care must be taken if the evaporator pressure is to be kept constant as the acoustic amplitude varies. Suction pressure valve 74 can be provided to maintain a constant evaporator pressure as the suction pressure drops below the design evaporator pressure. This type of valve, sometimes called a two temperature valve, is commonly available and can be found on single-compressor multi-evaporator systems, where each evaporator requires a different pressure.

It should be noted that whether the refrigerant entering heat exchanger coil 12 is a gas or a liquid, will be determined by the particular design requirements of a given application. The discharge pressure of the standing wave compressor will largely determine whether the refrigerant will enter heat exchanger coil 12 as a gas, liquid, or liquid-vapor mixture. If the discharge pressure is high enough for condensation to occur in air-cooled condenser 10, then the refrigerant will enter heat exchanger coil 12 as a liquid. If the discharge pressure is not high enough for condensation to occur in air-cooled condenser 10, then the refrigerant will enter heat exchanger coil 12 as a gas, and condense therein. For pressures between these two extremes, the refrigerant would enter heat exchanger coil 12 as a liquid-vapor mixture.

There are efficiency advantages associated with each of these two extremes of discharge pressure. For low discharge pressures, the "effective" condenser would be thought of as the combination of air-cooled condenser 10 and heat exchanger coil 12. Thus, the discharge pressure would be chosen on the basis of the temperature within heat exchanger coil 12, which is much lower than the temperature of air-cooled condenser 10. In this mode, the discharge pressure need not be any higher than is necessary for condensation to occur in heat exchanger coil 12. Therefore, discharge pressures can be used which are lower than would be possible if only air-cooled condenser 10 were present. A lower discharge pressure means greatly reduced power consumption of the standing wave compressor, which represents an energy savings.

For higher discharge pressure, condensation can occur in air-cooled condenser 10, and the refrigerant enters heat exchanger coil 12 as a liquid. Since a liquid offers better thermal contact with heat exchanger coil 12, subcooling is enhanced. So, for higher discharge pressures, the liquid refrigerant can be cooled to lower temperatures, and the refrigerating effect per pound of refrigerant circulated is increased due to reduced flashing in the evaporator.

It can be seen then, that there are efficiency advantages associated with each of these two extremes of discharge pressure. Any given design will represent a specific combination of these two types of energy savings, which is best suited to that particular design. In general, a control circuit can be built to exploit this entire range of discharge pressures in response to such changing conditions as the cooling load and the condensing medium's temperature.

Figure 5:
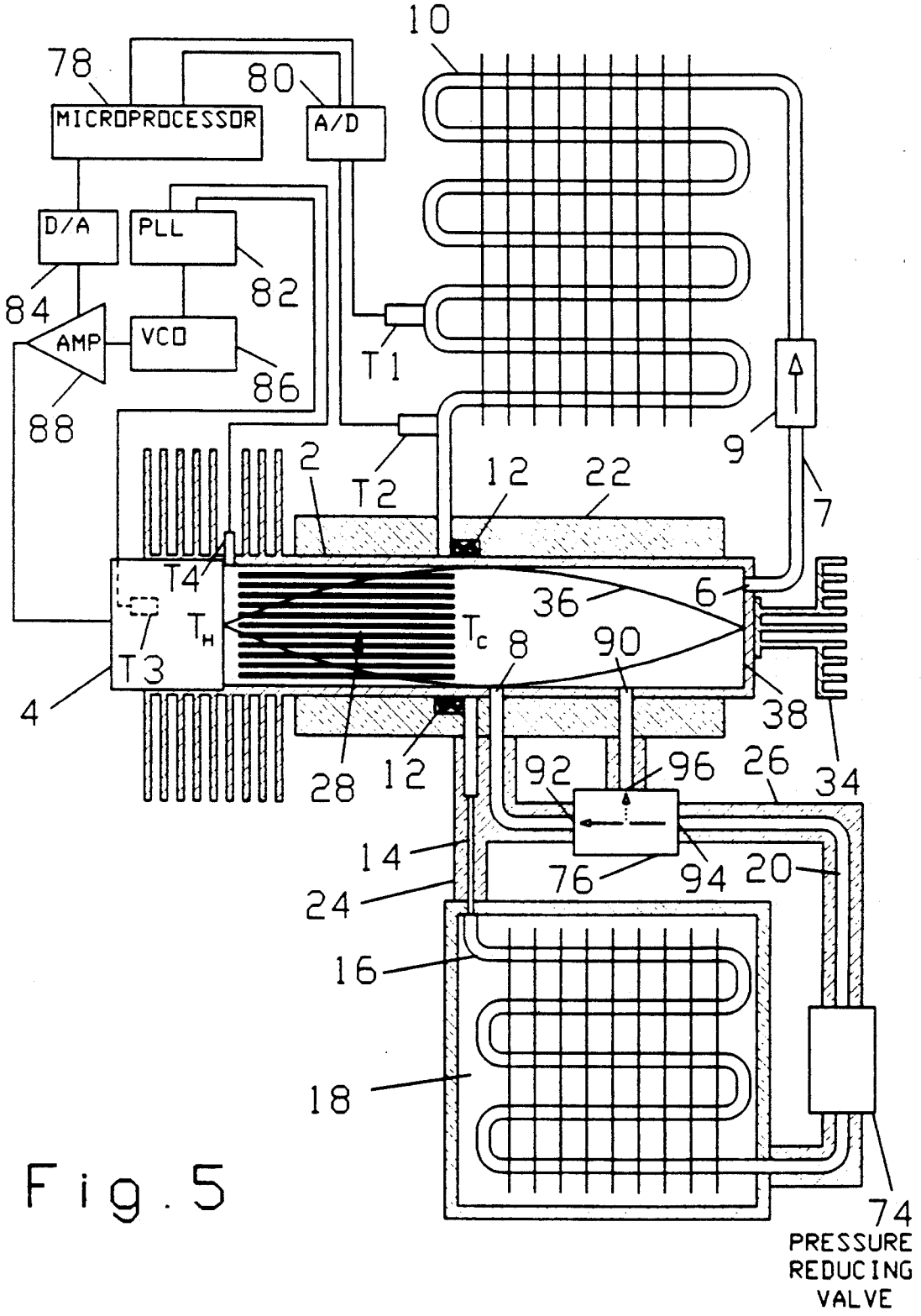
FIG. 5 is a section on line 3—3 of FIG. 1 and a block diagram of a control circuit for maintaining the minimal discharge pressure needed for condensation to occur.

FIG. 5 includes an example of a control circuit which provides automatic control of the discharge pressure. The circuit of FIG. 5 also provides an automatic frequency control, which keeps the frequency of acoustic driver 4 tuned to the acoustic resonance of chamber 2.

The control circuit of FIG. 5 includes a microprocessor 78, a dual analog-to-digital convertor 80, a phase-locked-loop chip 82, a digital-to-analog convertor 84, voltage controlled oscillator 86, and amplifier 88. Transducers T1, and T2, both measure the conductivity of the refrigerant inside condenser 10. A transducer T3 is an accelerometer, and is internally attached to the moving member of acoustic driver 4. A transducer T4 is a pressure transducer and measures the pressure oscillations immediately adjacent to acoustic driver 4. An additional suction port 90 has been added to chamber 2. A snap-action three-way valve 76 has also been added which serves to select either suction port 8 or suction port 90 as the active suction port. Valve 76 is equipped with ports 92, 94, and 96. In the closed position snap-action three-way valve 76 connects evaporator 16 to suction port 8. In the open position the valve 76 connects evaporator 16 to suction port 90. The valve 76 opens in response to a threshold pressure differential existing between port 92 and port 94.

Design assumptions have been made, for the sake of example, in the system of FIG. 5. In particular, it is assumed that the refrigerant is required to be in the liquid state before it enters heat exchanger coil 12.

In operation, the circuit of FIG. 5 acts to maintain the liquid level of condensed refrigerant in condenser 10, to a level between transducer T1 and transducer T2. Transducers T1 and T2 indicate the conductivity of the refrigerant with which they are in contact. A large change in conductivity exists between the liquid and gaseous state of most refrigerants. Thus, transducers T1 and T2 can indicate the state of the refrigerant with which they are in contact. The signals of transducers T1 and T2 are processed by dual analog-to-digital converter 80 and received by microprocessor 78. Microprocessor 78 periodically monitors transducers T1 and T2 for changes. If operating conditions cause the liquid refrigerant level to drop below transducer T2, this is detected by microprocessor 78. In response to this signal, microprocessor 78 sends a control signal to amplifier 88 via digital-to-analog convertor 84. The control signal acts to increase the gain of amplifier 88, thus boosting the power of acoustic driver 4, which in turn increases the amplitude of standing acoustic wave 36. This increased amplitude, provides a higher discharge pressure which promotes increased condensation in condenser 10. When the level of liquid refrigerant in condenser 10 rises past transducer T2, it is detected by microprocessor 78. In response, microprocessor 78 will maintain a constant acoustic amplitude and thus a constant discharge pressure.

If operating conditions cause the liquid refrigerant level to rise above transducer T1, this is detected by microprocessor 78. In response to this signal, microprocessor 78 sends a control signal to amplifier 88 via digital-to-analog convertor 84. This control signal acts to decrease the gain of amplifier 88, thus reducing the power of acoustic driver 4, which in turn reduces the amplitude of standing acoustic wave 36. This reduced amplitude provides a lower discharge pressure which causes decreased condensation in condenser 10. Once the level of liquid refrigerant in condenser 10 drops below transducer T1, this is detected by microprocessor 78. In response, microprocessor 78 will maintain a constant acoustic amplitude and thus a constant discharge pressure. Thus, the control circuit maintains the liquid refrigerant level in condenser 10, between transducers T2 and T1.

An automatic frequency control circuit is provided by transducers T3 and T4, phase-locked-loop chip 82, voltage controlled oscillator 86, amplifier 88, and acoustic driver 4. Maximum power transfer from acoustic driver 4 to standing acoustic wave 36, will occur when the dynamic pressure of standing acoustic wave 36 and the velocity of acoustic driver 4, are both in phase at the face of acoustic driver 4. Therefore, driver velocity and pressure signals are provided by respective transducers T3 and T4. The phase of the velocity and pressure signals is detected by PLL chip 82. If a nonzero phase is detected, then PLL chip 82 sends an analog signal to voltage controlled oscillator 86, thereby shifting the driving frequency towards the acoustic resonance of chamber 2. Amplifier 88 boosts the signal of voltage controlled oscillator 86, thus providing adequate power for acoustic driver 4, and the loop is completed. Thus, zero phase is maintained between velocity and pressure, and the driving frequency is locked to the acoustic resonance of chamber 2.

The operation of snap-action three-way valve 76 and suction pressure valve 74 are as follows. The system of FIG. 5 is designed such that the smallest acoustic amplitude corresponds to the condensing medium's lowest temperature. At the smallest acoustic amplitude, the suction pressure is made equal to the evaporator pressure, and suction pressure valve 74 is fully open. As the acoustic amplitude increases, the discharge pressure increases and the suction pressure drops below the designed evaporator pressure. At this point, pressure reducing valve 74 restricts the flow from evaporator 16 and holds evaporator 16 at the desired pressure. In some applications it may not be objectionable to let the evaporator pressure decrease slightly. In such cases, pressure reducing valve 74 could be eliminated.

It is undesirable to let the suction pressure drop to a level which is much lower than the evaporator's designed pressure. If this occurs, energy is wasted in recompressing the gas from unnecessarily low pressures. For this reason, snap-action three-way valve 76, and suction port 90 are provided. The average pressure distribution of a standing acoustic wave, varies from its lowest pressure at the pressure nodes, to its highest pressure at the pressure antinodes. Therefore, suction port 90 will provide a suction pressure which is higher than the pressure of suction port 8. As the acoustic amplitude is increased, the pressure of suction port 8 may become excessively low. Snap-action three-way valve 76 responds to this excessively low pressure by closing and thus selecting suction port 90 as the active suction port. In this way, the suction pressure can be maintained closer to the designed evaporator pressure during periods of high acoustic amplitude. Additional suction ports could be added between nodes and antinodes to provide an even greater selection of suction pressures. Automatic selection of these ports could be provided by electrical actuators selectively operated by a control circuit.

Even though suction port 90 is selected, the average pressure inside chamber 2 at suction port 8 can still be far below the designed evaporator pressure. However, this does not represent wasted energy, since this energy is stored in the acoustic resonance of chamber 2.

For smaller applications where initial cost is an important factor, valves 76 and 74 can be eliminated in exchange for reduced efficiency. Also, the control circuit can be eliminated in exchange for reduced efficiency, by maintaining a discharge pressure adequate for all operating conditions. In this case, the system would be designed in a manner similar to mechanical compressor systems.

Many different operating conditions are apt to change and can cause the level of liquid refrigerant in condenser 10 to vary. However, each will be treated equally by the control system. Thus, for any given set of operating conditions, the control circuit will maintain the minimum discharge pressure which is required for condensation to occur in the lower part of condenser 10.

Several different configurations of the cooling system, and corresponding control circuits, are possible. For example, the system could be designed to run at even lower discharge pressures, by moving the transducers T1 and T2 to the inlet and outlet respectively of heat exchanger coil 12. For this configuration, the "effective" condenser would be the combination of condenser 10 and heat exchanger coil 12. The control circuit would perform in exactly the same manner, except that the discharge pressure would be maintained at the minimum discharge pressure needed for condensation to occur in heat exchanger coil 12. Since this "effective" condenser provides a lower condensing medium temperature, a lower discharge pressure can be used, resulting in reduced power consumption of the standing wave compressor. Many other parameters of the system could be monitored by the control circuit to provide addition control and optimization of the cooling system.

For low cost applications, the microprocessor control circuit of FIG. 5 could be replaced by a simple switching network. Such a switching network would select a number of fixed power levels for acoustic driver 4, in response to signals from transducers T1 and T2. This switching control circuit would provide a limited number of fixed discharge pressures, rather than the continuously variable discharge pressure of the microprocessor control circuit. A switching control circuit would provide an approximation of the microprocessor control circuit. As explained above, the particular system configuration chosen will reflect the design requirements of a given application.

Variable capacity is also provided by the variable discharge pressure control system of FIG. 5. By virtue of the way this control system operates, variable capacity is spontaneously provided. This dual action is explained as follows. As the cooling load increases, the refrigerant flow rate increases, which causes the level of liquid refrigerant in condenser 10 to drop. The control system of FIG. 5 senses this drop in liquid refrigerant, and in response, increases the power of acoustic driver 4, thereby increasing the discharge pressure. This boosted discharge pressure increases the rate of condensation in condenser 10, which in turn raises the level of liquid refrigerant in condenser 10. When the cooling load decreases, the refrigerant flow rate decreases, which causes the level of liquid refrigerant in condenser 10 to rise. The control system responds to this drop in liquid refrigerant by decreasing the power of acoustic driver 4, thereby decreasing the discharge pressure. This reduced discharge pressure slows the rate of condensation in condenser 10, which in turn drops the level of liquid refrigerant in condenser 10. Therefore, it can be seen that power consumption varies with cooling load, which in effect provides a variable capacity system.

A control circuit, like that of FIG. 5, can be easily adapted to the microwave driving system of FIG. 4, as follows. First, an appropriate frequency locking control must be provided. For optimal operation, the microwave source should be pulsed on when the pressure antinode is at its point of highest pressure during an acoustic period. A single pressure transducer located in microwave cavity 40 of FIG. 4, can provide a reference signal for triggering the pulses of a microwave generator. Thus, since the microwave energy is pulsed on only when the antinode pressure is at its peak, the system will naturally remain in resonance. This simple arrangement eliminates the need for the PLL circuit 82 of FIG. 5.

Second, a means to vary the microwave power must be obtained to permit a variable discharge pressure. One easy method to vary the average microwave power, is to cause a periodic skipping of the microwave generator's trigger pulses. The number of pulses skipped would be inversely proportional to the discharge pressure of the standing wave compressor, and would be determined by selected operating conditions. Alternatively, more conventional methods, such as varying the high voltage on a microwave generating tube, could be used to control the microwave power. Such control arrangements will also exhibit the simultaneous advantages of variable capacity and variable discharge pressure.

It should be noted that a standing wave compressor cooling system, need not have the subcooling arrangement described herein, to benefit from the control systems described above. Such control systems will provide an efficiency gain for any cooling system which is subject to changes in condensing medium temperature, and cooling load. Consequently, the compression-evaporation cooling system described herein, can be employed in many different cooling applications, including air-conditioners, heat pumps, chillers, water coolers, refrigerators, and many more.

Types of Acoustical Drivers

A variety of acoustical drivers exist which can drive the standing wave compressor. The use of an ultrasonic driver was disclosed in U.S. patent application Ser. No. 07/380,719 filed Jul. 12, 1989. Such ultrasonic drivers provide a means to achieve high dynamic pressures at high acoustic frequencies. When working at lower acoustic frequencies, other types of acoustic drivers can be employed to provide the high dynamic pressures needed for refrigeration applications. Another class of drivers which can provide high acoustic power at sonic frequencies, are commonly referred to as "nonlinear drivers." Whereas linear drivers produce a force or pressure which is proportional to the driving current, nonlinear drivers produce a force or pressure which is proportional to the square of the driving current.

For sound reproduction, nonlinear behavior is highly undesirable. Thus, compared to linear acoustic drivers, nonlinear drivers have seen little commercial realization. However, when the primary concern is efficient transduction from electric to acoustic power, nonlinear drivers have distinct advantages.

Figure 6:
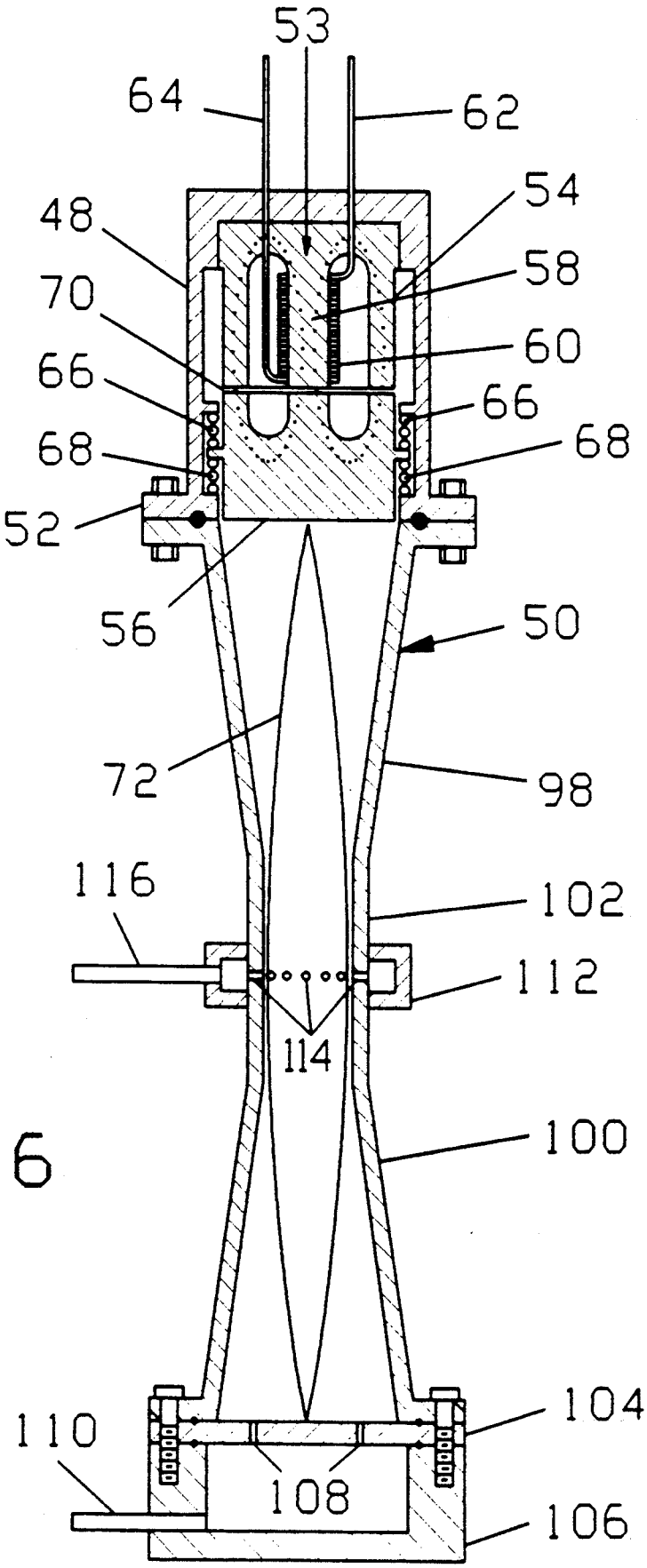
FIG. 6 is a sectional view of an alternate embodiment of an acoustic chamber and a nonlinear acoustic driver.

FIG. 6 is a sectional view of one embodiment of a nonlinear driver. A driver chamber 48 is provided which houses the driver assembly. Driver chamber 48 is fastened to an acoustic chamber 50, by means of flange 52 and common flange bolts. An iron core inductor 53 is comprised of a fixed section 54 and an oscillating section 56. Fixed section 54 is press fitted into driver chamber 48. An inner core 58 of fixed section 54 is provided with a coil 60. Wires 62 and 64 supply an alternating current to coil 60. Oscillating section 56 is supported by springs 66 and 68, and is free to oscillate in the longitudinal direction of acoustic chamber 50.

In operation, an oscillating current is applied to wires 62 and 64, which in turn causes an oscillating magnetic field, as shown by the dotted lines, to exist inside iron core inductor 53. The magnetic force exerted on oscillating section 56 by fixed section 54 is proportional to the square of the current. If the current "i" is varied in time with frequency "f," then the oscillating section 56 will oscillate with frequency "2f."

Springs 66 and 68 are chosen so that the spring-mass system, consisting of oscillating section 56 and springs 66 and 68, will be resonant at the desired acoustic frequency of the standing wave. In this way, the moving mass "m" of oscillating section 56 (which can be very large compared to the moving mass of conventional high-fidelity loudspeakers), can be stored in the resonance of the spring-mass system. If the frequency of oscillation of oscillating section 56 is equal to "2f," then $$2(2\pi f)=(k/m)^{\frac{1}{2}}$$

and very large displacements "x" can be achieved with forces much smaller than would be expected from Hooke's law:

$$F=-kx=-(4\pi f)^2mx.$$

Oscillating section 56 imparts the acoustic energy to the gas in acoustic chamber 50 which is necessary to establish standing acoustic wave 72. In practice, the interaction of oscillating section 56 with the gas in acoustic chamber 50 will make a contribution to spring constant "k." This is due to the fact that at resonance, the pressure oscillations at the face of the driver will be in phase with the velocity of the driver face.

A paper by W. B. Wright and G. W. Swift entitled, Parametrically Driven Variable-Reluctance Generator (soon to be published in the Journal of the Acoustical Society of America), describes a similar transducer, and demonstrates its high efficiency. Thus, it can be seen that such a nonlinear driver is capable of producing large pressure amplitude acoustic waves, with a high electro-acoustic efficiency.

Another example of a nonlinear driver, is one in which the force generated by the driver is the result of the current's interaction with itself. In this case the force will again vary as the square of the driving current. One such example of a self interacting current is seen in a paper by Hillary W. St. Clair, An Electromagnetic Sound Generator For Producing Intense High Frequency Sound, Rev. Sci. Instrum. Vol. 12, p. 250 (1941). Other examples of nonlinear drivers include unbiased magnetostrictive and electrostatic transducers.

Practical nonlinear drivers generally posses a very narrow resonance band width. Therefore, to maintain the driver's resonance, it is usually desirable to allow the nonlinear driver to operate in a self-exciting mode. This can be accomplished by allowing the driver to act as a reactance in a resonant electrical circuit. In this way the resonant frequency of the driving circuit will remain tuned to the resonance of the nonlinear driver.

Another type of acoustical driver which can be used for low frequency high acoustic power applications, is a driver commonly referred to as a "linear motor." Such devices work along the same principles as electric motors, except that the motion is one dimensional rather than rotational. Typically, a moving piston is driven back and forth by an oscillating magnetic field. The piston is a "free piston" which actually floats on a thin cushion of gas between the piston and the chamber wall. For the present invention, this layer of gas would consist of the working refrigerant. Because of this gas bearing, no contact occurs between the chamber wall and the piston, thus no lubricating oil is required. Linear motors have been designed for use in Stirling engines, with efficiencies up to 95%. An example of a linear motor can be seen in U.S. Pat. No. 4,602,174 to Robert W. Redlich Jul. 22, 1986.

The above list of drivers will suggest many other ways to design efficient high power acoustic drivers. This list of drivers is not intended as a limit on the scope of the invention, but rather to serve as a further indication of the variety of acoustic drivers which can be used to drive the standing wave compressor.

Improved Acoustic Chamber

FIG. 6 shows an acoustic chamber 50 whose varying cross section offers certain advantages. Chamber 50 is comprised of a variable cross section segment 98, a variable cross section segment 100, and a cylindrical center section 102. Cylindrical center section 102 connects variable cross section segments 98 and 100. Chamber 50 is terminated by a discharge plate 104 and a discharge chamber 106. Discharge plate 104 is sandwiched between acoustic chamber 50 and discharge chamber 106, and held together by common flange bolts. A multiplicity of discharge ports 108 are drilled through discharge plate 104. A multiplicity of suction ports 114 are drilled through center section 102. Suction chamber 112 forms an outer chamber around suction ports 114.

Once the acoustic wave 72 is established in acoustic chamber 50, gaseous refrigerant is drawn in turn through suction tube 116, into suction chamber 112, through suction ports 114, and into acoustic chamber 50. Having been acoustically compressed by acoustic wave 72, the gaseous refrigerant escapes in turn through discharge ports 108, into discharge chamber 106, and through discharge tube 110. Acoustic chamber 50 can also be fitted with a heat pump plate stack.

Acoustic chamber 50 offers the following three advantages. First, by properly designing the relative lengths of variable cross section segment 98, variable cross section segment 100, and center section 102, unwanted higher ordered acoustic modes can be suppressed. These higher modes can diminish a standing wave compressor's pressure differential and interfere with heat pumping along a set of heat pump plates. Thus, higher order modes can reduce a standing wave compressor's efficiency.

Secondly, acoustic chamber 50 provides a higher pressure differential between suction and discharge ports, than the pressure differential of a standard cylindrical chamber. This is due to the venturi effect produced by the varying cross sectional area of acoustic chamber 50.

Thirdly, by providing a multiplicity of small diameter suction and discharge ports, turbulence is reduced. Larger ports would tend to create turbulence which dissipates acoustic energy, thereby reducing efficiency.

Many variations on the acoustic chamber shown in FIG. 6 are possible, and can provide these same advantages. However, a varying cross section is the common feature which allows any such chamber variation to provide these same advantages. Accordingly, it is the use of one or more chamber segments of varying cross section, rather than any specific design features, which is the subject of this chamber improvement.

The present invention provides a new compression-evaporation cooling system, wherein a standing wave compressor serves to compress the gaseous refrigerant, and to subcool that refrigerant by means of an acoustical subcooling system. Also, this subcooling system improves efficiency by reducing refrigerant flashing, consumes little additional energy, and takes up no additional space, since it is internal to the standing wave compressor.

Further, in accordance with the present invention, a standing wave compressor can simultaneously alter both its discharge pressure and its capacity, as a function of various operating conditions, thereby providing a means to continually minimize the power consumption of the refrigeration system. Still further, an improved acoustic chamber can suppress unwanted higher acoustic modes, and promote a larger pressure differential. Finally, many practical, efficient, high power acoustic drivers are available for the standing wave compressor.

While the above description contains many specifications, these should not be construed as limitations on the scope of the invention, but rather as an exemplification of one preferred embodiment thereof. Many other variations are possible, and may readily occur to those skilled in the art. For example, in higher evaporator temperature applications, where large pressure differentials are not necessary, the discharge gas will not be as hot, and air-cooled condenser 10 of FIG. 1 and FIG. 2 could be reduced in size or removed altogether. In this case the heat exchanger coil 12 would serve as the primary condensing medium. The number of loops in heat exchanger coil 12 could be increased as necessary to improve the rate of heat transfer.

Moreover, more than one heat pump plate stack 28 can be used in chamber 2. The heat pump plate stack 28 is placed between a pressure node and a pressure antinode. Therefore, a standing acoustical wave with several nodes and antinodes could support more than one heat pump plate stack 28. Such additional heat pump plate stacks would increase the heat load capacity of the subcooling system. Alternatively, one plate stack could be used for condensing, and the other plate stack could be used for subcooling.

Also, other features which are common to refrigeration technology, could be added. For example, capillary tube 14, could be replaced with many different types of common refrigerant controls which are more responsive to changing operating conditions.

In addition, other apparatus besides heat fins 32 and 34 could be used to carry away excess heat. A small fan could be added to force air through the heat fins 32 and 34, thereby improving the rate of heat exchange with the surrounding air. Another alternative would be to provide a closed loop liquid coolant circulation system, in which a coolant would flow through heat exchangers, with the heat exchangers being in thermal contact with the hot side $T_H$ of heat pump plate stack 28, and end wall 38. The coolant would flow in turn through these heat exchangers, and then into an air-cooled radiator where the liquid would transfer its heat.

Furthermore, plate stack 28 can be constructed of many different materials, such as fiberglass, plastics, or wire screens. These various plate stacks can be arranged longitudinally or transversely along chamber 2. Other geometries besides plates can be used, such as a continuous spirals or concentric cylindrical plates placed longitudinally along chamber 2. It should be noted that the acoustic heat pumping effect can occur without any plates at all, although at a reduced level. The magnitude of acoustic heat pumping which will occur is proportional to the working surface area exposed to the standing wave.

Additionally, the heat exchanger coil 12 could be replaced with other types of heat exchangers. One such heat exchanger could be formed by replacing copper strips 30C with small channels which would be in thermal contact with the cold end $T_C$ of heat pump plate stack 28. The refrigerant could then pass through these channels, thereby giving up heat to the plates inside chamber 2. This arrangement would provide a more direct heat exchange between the refrigerant and the plates, than would be provided by heat exchanger coil 12. In this way, the refrigerant is promoted as the primary heat source for heat pump plate stack 28.

Other chamber geometries, besides the cylindrical chamber 2, and other acoustic modes can be used to support a standing wave pattern. For example, a cylindrical chamber, whose radius is large relative to its length, can oscillate in a radial mode. Then an internal stack of circular plates coincident with the cylinder's axis could be used for heat pumping. Also, a spherical chamber can be made to oscillate in a radial mode. Radial mode oscillations have the advantage of concentrating the acoustic wave's pressure at the center of the chamber. Different chamber geometries, such as cylinders and spheres, can be combined to form Helmholtz resonators. In short, any chamber which will support a standing acoustic wave can be used. Electromagnetic-gas interactions can be used to acoustically drive any of these chambers.

Finally, U.S. patent application Ser. No. 07/380,719 filed Jul. 12, 1989, suggests many other embodiments of, and variations on, standing wave compressors which can be used in the present invention.

Accordingly, the scope of the invention should be determined not by the embodiments illustrated, but by the appended claims and their equivalents.

What is claimed is:

1. A refrigerant compressor comprising:

a standing wave compressor which receives, acoustically compresses, and discharges a refrigerant, said standing wave compressor having a variable power acoustic driving means for driving said standing acoustic wave, said variable power acoustic driving means having at least first, second and third different power levels; and control means for varying the power of said variable power acoustic driving means as a function of changing operating conditions, so that the capacity and discharge pressure of said standing wave compressor is varied as a function of changing operating conditions.

2. A refrigerant compressor as set forth in claim 1, wherein said variable power acoustic driving means comprises a linear motor.

3. A refrigerant compressor as set forth in claim 1, wherein said variable power acoustic driving means comprises a nonlinear driver and wherein the pressure exerted by said nonlinear driver varies as the square of a driving current.

4. A refrigerant compressor comprising:

a standing wave compressor which receives, acoustically compresses, and discharges a refrigerant;

one or more heat pumping surfaces, said one or more heat pumping surfaces being exposed to a standing acoustic wave existing within said standing wave compressor, the standing acoustic wave creating a temperature differential along said one or more heat pumping surfaces, such that said one or more heat pumping surfaces develops a cold end and a hot end;

cold end heat exchanger means for providing thermal contact between a refrigerant and the cold end of said one or more heat pumping surfaces;

hot end heat exchanger means for providing thermal contact between a heat sink and the hot end of said one or more heat pumping surfaces.

5. A refrigerant compressor as set forth in claim 4, wherein said standing wave compressor has a variable power acoustic driving means for driving the standing acoustic wave, and wherein said refrigerant compressor further comprises control means for varying the power of said variable power acoustic driving means as a function of changing operating conditions, so that the capacity and discharge pressure of said standing wave compressor is varied as a function of changing operating conditions.

6. A compression-evaporation cooling system comprising:

a standing wave compressor which receives, acoustically compresses, and discharges a refrigerant;

one or more heat pumping surfaces, said one or more heat pumping surfaces being exposed to a standing acoustic wave existing within said standing wave compressor, the standing acoustic wave creating a temperature differential along said one or more heat pumping surfaces, such that said one or more heat pumping surfaces develops a cold end and a hot end;

cold end heat exchanger means for providing thermal contact between a refrigerant and the cold end of said one or more heat pumping surfaces;

hot end heat exchanger means for providing thermal contact between a heat sink and the hot end of said one or more heat pumping surfaces;

a refrigerant condenser;

a refrigerant evaporator;

refrigerant metering means for controlling the flow of said refrigerant from said cold end heat exchanger means into said refrigerant evaporator;

first conduit means for connecting said standing wave compressor to said refrigerant condenser;

second conduit means for connecting said refrigerant condenser to said cold end heat exchanger means;

third conduit means for connecting said cold end heat exchanger means to said refrigerant metering means;

fourth conduit means for connecting said refrigerant metering means to said refrigerant evaporator;

fifth conduit means for connecting said refrigerant evaporator to said standing wave compressor.

7. A compression-evaporation cooling system as set forth in claim 6, wherein said standing wave compressor has a plurality of suction ports, and wherein said compression-evaporation cooling system further comprises:

a suction port selector valve connecting said refrigerant evaporator to one of said plurality of suction ports;

a suction pressure valve located between said refrigerant evaporator and said suction port selector valve;

flow rectifying means, located between said discharge port of said standing wave compressor and said refrigerant condenser, for preventing any flow of said refrigerant from said refrigerant condenser to said standing wave compressor;

control means for controlling the capacity and discharge pressure of said standing wave compressor by varying the amplitude of the standing acoustic wave in response to changing operating conditions, said control means acting to maintain the minimum discharge pressure required for refrigerant condensation to occur at any given set of operating conditions.

8. A compression-evaporation cooling method comprising the steps of:

(a) acoustically compressing and discharging a refrigerant using a standing wave compressor;

(b) positioning one or more heat pumping surfaces such that the heat pumping surfaces are exposed to a standing acoustic wave which exists within the standing wave compressor, and such that the standing acoustic wave creates a temperature differential along the one or more heat pumping surfaces to cause the one or more heat pumping surfaces to develop a cold end and a hot end;

(c) placing a cold end heat exchanger in thermal contact with the cold end of the one or more heat pumping surfaces, such that a refrigerant flowing through the cold end heat exchanger will give up heat to the one or more heat pumping surfaces;

(d) placing a heat sink in thermal contact with the hot end of the one or more heat pumping surfaces, such that the hot end of the one or more heat pumping surfaces will give up heat to the heat sink means;

(e) connecting a discharge port of the standing wave compressor to the input of a refrigerant condenser by way of a first conduit;

(f) connecting the output of the refrigerant condenser to the input of the cold end heat exchanger by way of a second conduit;

(g) connecting the output of the cold end heat exchanger to the input of a liquid refrigerant meter by way of a third conduit;

(h) connecting the output of the liquid refrigerant meter to the input of a refrigerant evaporator by way of a fourth conduit; and (i) connecting the output of the refrigerant evaporator to a suction port of the standing wave compressor by way of a fifth conduit so that the standing wave compressor motivates the refrigerant through a compression-evaporation refrigeration cycle, as well as continually cooling the refrigerant before the refrigerant enters the refrigerant evaporator.

9. A refrigerant compressor comprising a standing wave compressor which receives, acoustically compresses, and discharges a refrigerant, said standing wave compressor having an acoustic chamber with one or more segments of varying cross sectional area, said acoustic chamber suppressing predetermined higher acoustic modes, and increasing the effective pressure differential of said standing wave compressor.

10. A refrigerant compressor comprising:

a standing wave compressor having a variable power acoustic driver for driving a standing acoustic wave to compress a refrigerant, said variable power acoustic driver having at least first, second and third different power levels; and control means for varying the power of said variable power acoustic driver based on changes in operating conditions of said standing wave compressor, so that the discharge pressure of said standing wave compressor is varied as a function of changing operating conditions.

11. A refrigerant compressor as set forth in claim 10, wherein said variable power acoustic driver comprises a non-linear driver, and wherein the pressure exerted by said non-linear driver varies as the square of a driving current.

12. A refrigerant compressor comprising:

a standing wave compressor for compressing a refrigerant by creating a standing acoustic wave which produces a temperature differential along said standing wave compressor, so that a first portion of said standing wave compressor is at a temperature which is higher than a second portion of said standing wave compressor;

a heat exchanger coupled to said standing wave compressor adjacent said second portion of said standing wave compressor and carrying the refrigerant, said heat exchanger providing thermal contact between the refrigerant and the second portion of said standing wave compressor.

13. A refrigerant compressor as set forth in claim 12, further comprising a heat pumping surface positioned in said standing wave compressor and exposed to the standing acoustic wave existing within said standing wave compressor, wherein said heat pumping surface has first and second ends, wherein the second end of said heat pumping surface is adjacent the second portion of said standing wave compressor.

14. A refrigerant compressor as set forth in claim 13, further comprising an additional heat exchanger coupled to said standing wave compressor, for providing thermal contact between a heat sink and the first end of said heat pumping surface.

15. A refrigerant compressor as set forth in claim 12, wherein said standing wave compressor includes an acoustic chamber having at least one segment of varying cross-sectional area, and wherein said acoustic chamber suppresses predetermined acoustic modes to increase the effective pressure differential of said standing wave compressor.

16. A refrigerant compressor as set forth in claim 12, wherein said standing wave compressor comprises a non-linear driver, and wherein the pressure exerted by said non-linear driver varies as the square of a driving current.

17. A compression/evaporation cooling system comprising:

a standing wave compressor for compressing a refrigerant by creating a standing acoustic wave which produces a temperature differential along said standing wave compressor, so that a first portion of said standing wave compressor is at a temperature which is higher than a second portion of said standing wave compressor;

a refrigerant condenser, coupled to said standing wave compressor, for condensing the compressed refrigerant;

a heat exchanger, coupled to said refrigerant condenser and to said standing wave compressor adjacent said second portion of said standing wave compressor, said heat exchanger providing thermal contact between the condensed refrigerant and the second portion of said standing wave compressor; and a refrigerant evaporator, coupled to said heat exchanger and said standing wave compressor, for evaporating the condensed refrigerant provided by said heat exchanger and for providing the evaporated refrigerant to said standing wave compressor.

18. A compression/evaporation cooling system as set forth in claim 17, further comprising a heat pumping surface positioned in said standing wave compressor, wherein said heat pumping surface has a first end adjacent said first portion of said standing wave compressor and a second end adjacent said second portion of said standing wave compressor, so that the temperature at the first end of said heat pumping surface is higher than the temperature at the second end of said heat pumping surface.

19. A compression evaporation cooling system as set forth in claim 17, wherein said standing wave compressor includes an acoustic chamber having at least one segment of varying cross-sectional area, and wherein said acoustic chamber suppresses predetermined acoustic modes to increase the effective pressure differential of said standing wave compressor.

20. A compression/evaporation cooling system as set forth in claim 17, wherein said standing wave compressor comprises a non-linear driver, and wherein the pressure exerted by said non-linear driver varies as the square of a driving current.

21. A refrigerant compressor comprising a standing wave compressor which acoustically compresses a refrigerant by using a standing acoustic wave, said standing wave compressor having a linear motor for driving the standing acoustic wave.

22. A refrigerant compressor comprising a standing wave compressor which receives, acoustically compresses, and discharges a refrigerant, said standing wave compressor including an acoustic chamber having at least first and second different cross sectional areas at at least first and second positions, respectively, along said acoustic chamber.

23. A refrigerant compressor comprising a standing wave compressor which receives, acoustically compresses, and discharges a refrigerant, said standing wave compressor including an acoustic chamber having at least first and second different cross sectional areas at at least first and second positions, respectively, along said acoustic chamber, said acoustic chamber suppressing selected acoustic modes.

24. A compression-evaporation system comprising:

a standing wave compressor which receives, acoustically compresses and discharges a refrigerant, said standing wave compressor including an acoustic chamber having at least first and second different cross-sectional areas at at least first and second positions, respectively, along the acoustic chamber; and means, coupled to said standing wave compressor, for subjecting the discharged refrigerant to a heat exchange operation.

25. A compression-evaporation system according to claim 24, wherein said acoustic chamber has one or more segments of varying cross-sectional area.

* * * * *